US005474472A

United States Patent [19]

Niwa et al.

[11] Patent Number: 5,474,472

[45] Date of Patent: Dec. 12, 1995

[54] SHIELDED ELECTRICAL CONNECTOR

[75] Inventors: Takeo Niwa, Kawasaki; Yoshitsugu Fujiura, Tokyo; Hiromitsu Kodama, Kanazawa, all of Japan

[73] Assignee: The Whitaker Corporation, Wilmington, Del.

[21] Appl. No.: 33,730

[22] Filed: Mar. 18, 1993

[30] Foreign Application Priority Data

Apr. 3, 1992 [JP] Japan ..... 4-082166

[51] Int. Cl.[6] ..... H01R 13/648

[52] U.S. Cl. ..... 439/608; 439/108

[58] Field of Search ..... 439/92, 95, 101, 439/108, 607, 608, 609, 610

[56] References Cited

U.S. PATENT DOCUMENTS 4,846,727 7/1989 Glover et al. ..... 439/608
5,102,353 4/1992 Brunker et al. ..... 439/108 X
5,116,230 5/1992 Dechelette et al. ..... 439/101
5,160,273 11/1992 Carney ..... 439/608 X
5,169,324 12/1992 Lemke et al. ..... 439/101
5,183,405 2/1993 Elicker et al. ..... 439/108

FOREIGN PATENT DOCUMENTS 49-6543 2/1979 Japan .

*Primary Examiner*—Khiem Nguyen
*Attorney, Agent, or Firm*—Adrian J. LaRue; Timothy J. Aberle

[57] ABSTRACT

An electrical connector assembly (10,30) includes a metal sheet (20,42), which is in electrical contact with a metal shell (14,32), is embedded in an internal partition (18,40) of a housing (24,44) separating rows of contacts (16,38) for reducing electrical cross-talk between the contacts (16,38).

11 Claims, 9 Drawing Sheets

SHIELDED ELECTRICAL CONNECTOR

The invention relates to electrical connectors, especially to such connectors having several rows of contacts and an outer metallic shell.

BACKGROUND OF THE INVENTION

A shielded electrical connector is provided having several rows of contacts inside the housing and an outer metallic shell for the purpose of shielding. Such shielded electrical connectors are widely used in computers, work stations and other types of electronic office equipment for the connection of signal-carrying lines.

In such shielded electrical connectors, the metal shell prevents electromagnetic noise from penetrating into the connector, but it does not eliminate the problem related to cross-talk between contact pins. In order to solve the problem of cross-talk, a metal sheet is installed between the rows of the contact pins.

FIG. 10 is an oblique view of an electrical connector of a conventional type as disclosed in Japanese Utility Model 49-6543. As can be seen from FIG. 11, pin-shaped contacts 2 are arranged basically in two rows separated by a metal sheet 2. At the time of connection, this metal sheet 2 is inserted in slits 3 of the housing shown in FIG. 10. FIGS. 12 and 13 are oblique projections of the connector parts shown in FIGS. 10 and 11 with cross-sections made along lines A—A' and B—B'. The metal sheet 2 has a tie-in 4 which, at the time of connection, comes in contact with tie-in 6, thus electrically separating the two rows of contacts 1.

However, the trend of decreasing dimensions of electronic equipment developed in recent years led to a necessity to reduce the dimensions of the connectors for interface devices. For example, in high-performance CPU's operating at 32 bits used in electronic equipment, the number of contacts in a given interface connector may be as high as 200. As a result of the requirements to increase the number of contacts in such small connectors, distances between the contacts were drastically reduced, which led to increased problems of cross-talk and insufficient speed of operation. In such cases, if measures were taken in the form of a metal sheet 2, such as is shown in FIGS. 10–13, this sheet often failed to produce a proper connection at the time of joining the two halves of the connector which often resulted in damage.

Another effect of size scale-down is that the layer of insulating material between the contacts becomes very thin, which may lead to damage of the housing. In addition, if tie-ins 4 and 6 are provided for the metal sheet 2, as shown in FIGS. 10 and 13, the pitch of the signal contact pins 1 must be increased, which defeats the requirement of the decrease in dimensions of the connector.

Considering the above circumstances, the purpose of the instant invention is to offer a mechanically strong, miniature shielded electrical connector having a high density of contacts with substantially reduced cross-talk and reduced noise interference between the rows of contacts.

SUMMARY OF THE INVENTION

The shielded electrical connector according to the instant invention consists of a housing, several rows of contacts separated by an internal partition of the housing, and a metal shell covering at least the perimeter of the mating portion. Additionally, it is characterized by the fact that it has a metal sheet incorporated in the above-mentioned internal partitions and making electrical contact with the metal shell.

The above mentioned metal sheet can be either pressed into the internal partitions or it can be insert-molded when the housing is manufactured.

The shielded electrical connector according to the instant invention, corresponding to the requirements of miniaturization and a high operating speed, has a metal sheet eliminating cross-talk between the contacts because it is disposed in the internal partitions of the housing, thus preventing the sheet's damage despite the insufficiency of its own strength. In addition, since the metal sheet is in contact with the metal shell, there is no need for the tie-in 4 (see FIGS. 11–13) used in conventional connectors, which makes it possible to further reduce the dimensions of the connector and to eliminate the operation related to bending and installation of the tie-in during assembly of the connector, thus reducing its production costs. Such a design also eliminates the need for an additional conductive pad on the base board in the connectors in which tie-ins of the contacts are soldered to the conductive pads on the base board.

DESCRIPTION OF THE PREFERRED EMBODIMENT(S)

Figure 1:
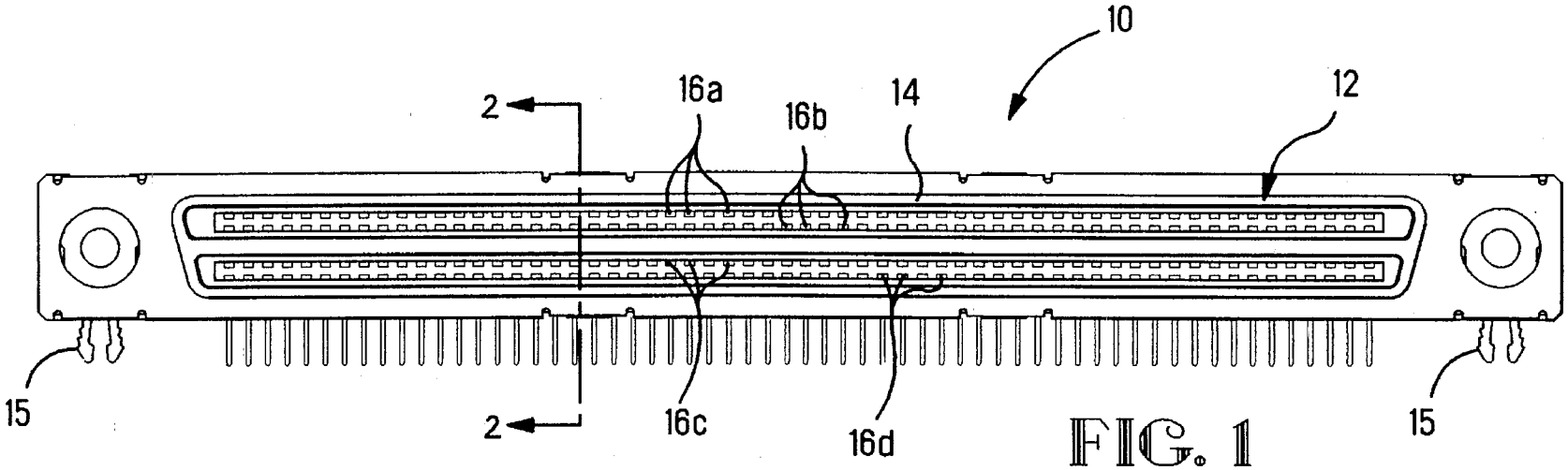
FIG. 1 is a front elevational view of the side of mating a shielded electrical connector according to the instant invention.
Figure 2:
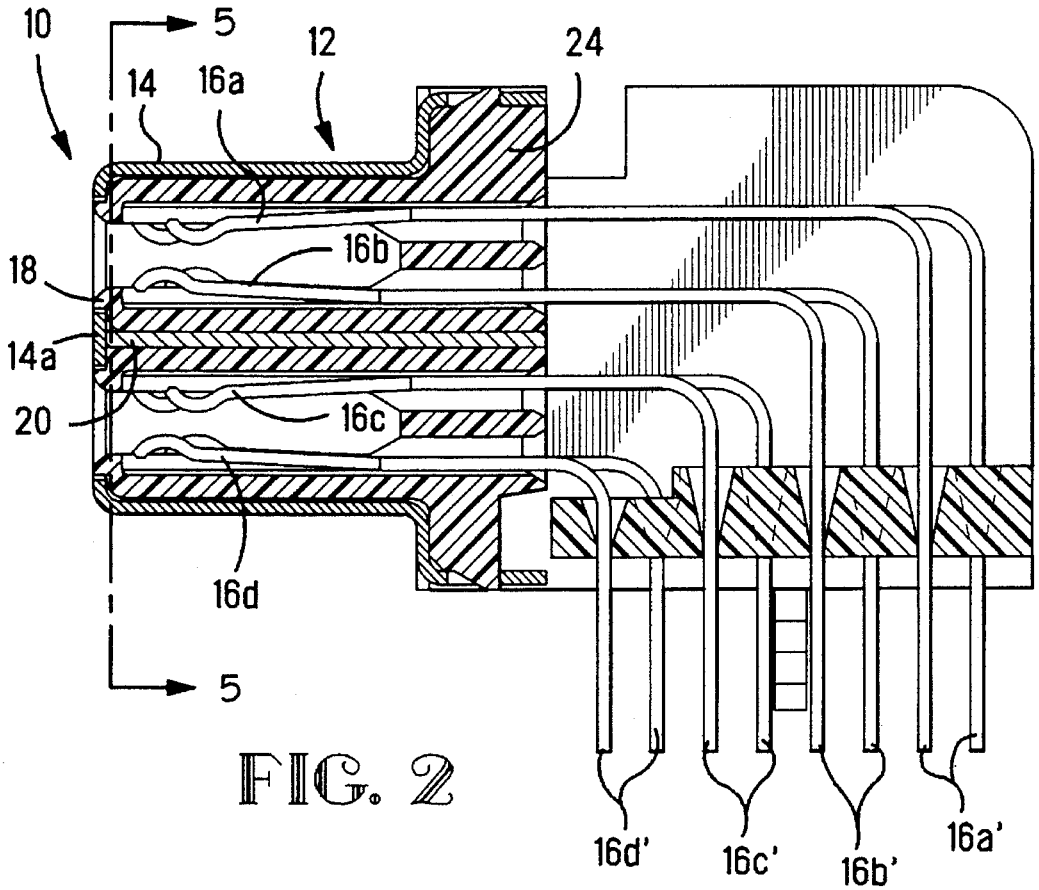
FIG. 2 is a cross-sectional view taken along line 2—2 shown in FIG. 1.
Figure 5:
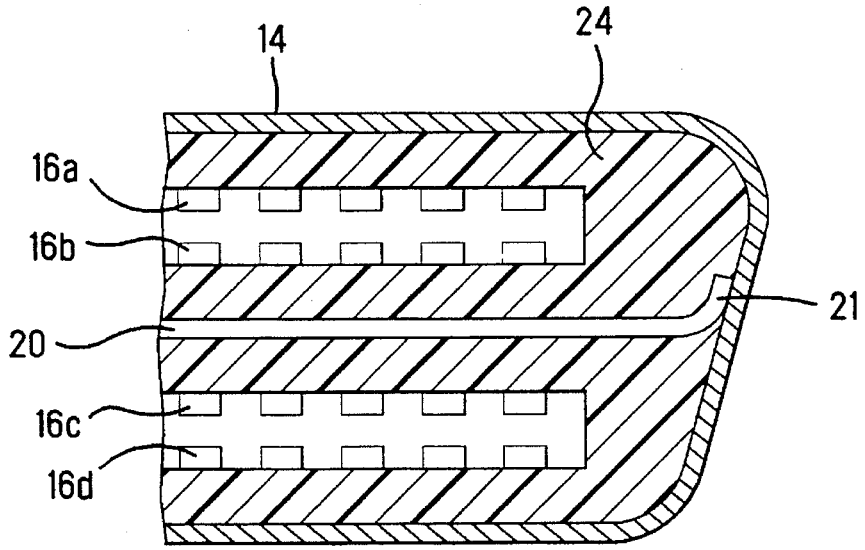
FIG. 5 is a cross-sectional view taken along line 5—5 shown in FIG. 2.
Figure 3:
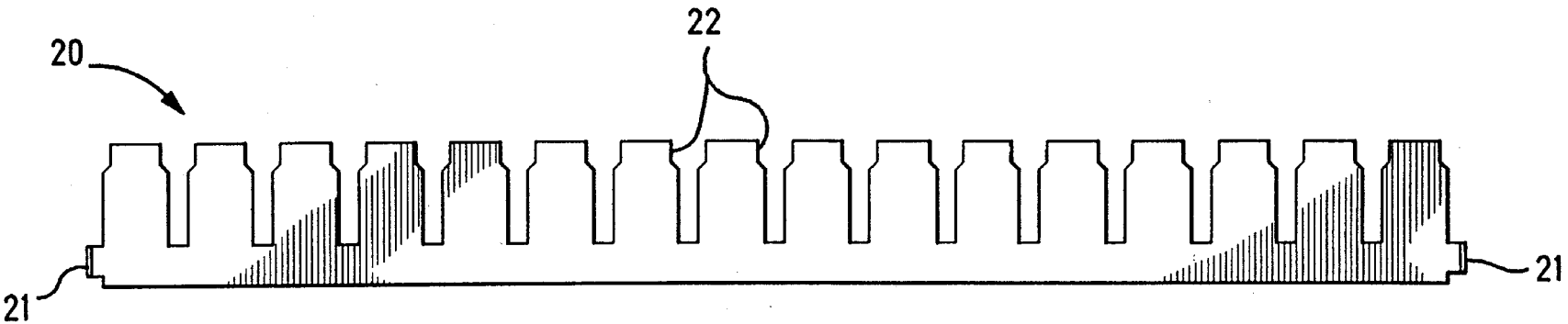
FIG. 3 is a plan view of the metal sheet of FIG. 1.
Figure 4:
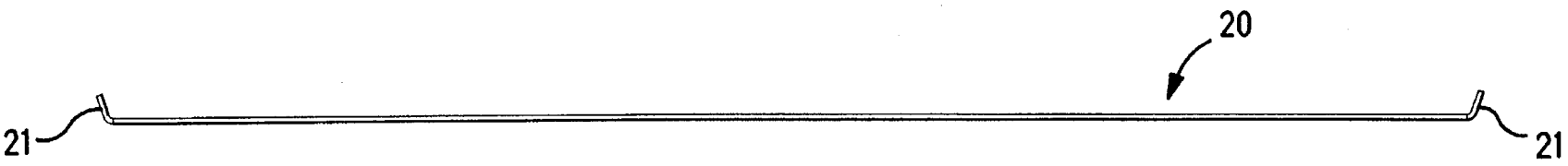
FIG. 4 is a side view of the metal sheet of FIG. 1.

FIG. 1 is a front view of the first embodiment of the shielded electrical connector according to the instant invention as seen from the side of a matching or mating connector; FIG. 2 is a cross-section of the connector shown in FIG. 1 along line 2—2; FIG. 3 is a top and FIG. 4 is a front view of the metal sheet incorporated in the shielded electrical connector; FIG. 5 is a cross-section of the detail shown in FIG. 2 along line 5—5.

Referring now to FIGS. 1 and 2, the shielded electrical connector 10 has a mating portion 12 protruding forwardly. The matching or mating portion 12 is surrounded by a metal shell 14 shaped approximately as the letter "D". The metal shell 14 is grounded to the base board (not shown in the drawing) by means of metal fasteners 15, thus reducing penetration of outside signal noise.

Inside the connector 10, there are 4 rows of contacts 16*a*, 16*b*, 16*c*, and 16*d*, arranged as upper and lower contacts, as shown in FIGS. 1 and 2. Tie-ins 16*a'*, 16*b'*, 16*c'*, and 16*d'* of contacts 16*a*, 16*b*, 16*c* and 16*d* extend from the housing 24 downward, as seen in FIGS. 1 and 2, to terminals made on the printed circuit board (not shown in the drawing) to which they are soldered. Contacts 16*b* of the second row and contacts 16*c* of the third row are separated by the internal partition 18 of the housing 24. A metal sheet 20 having the shape shown in FIGS. 3 and 4 is pressed into the internal partition 18. At both ends of the metal sheet 20, there are bends 21 and grooves 22 which can be seen in FIG. 3. When the metal sheet 20 is pressed into the internal partition 18, the bends 21 come in contact with the metal shell 14, as shown in FIG. 5. Due to this contact, an electrical connection is formed between the metal sheet 20 and the metal shell 14, thus preventing cross-talk between the upper rows of contacts 16*a* and 16*b*, and the two lower rows 16*c* and 16*d*. The metal sheet 20 does not have a tie-in similar to tie-ins 16*a'*, 16*b'*, 16*c'* and 16*d'* of the contacts 16*a*, 16*b*, 16*c* and 16*d*, which makes it possible to reduce the dimensions of contacts 10 and to facilitate assembly operations. In addition, since the metal sheet 20 is embedded in the internal partition 18 of the housing 24, it can be made of thin material because it is protected by the internal partition, thus eliminating the danger of break down or damage at the time of connection to another connector.

Figure 6:
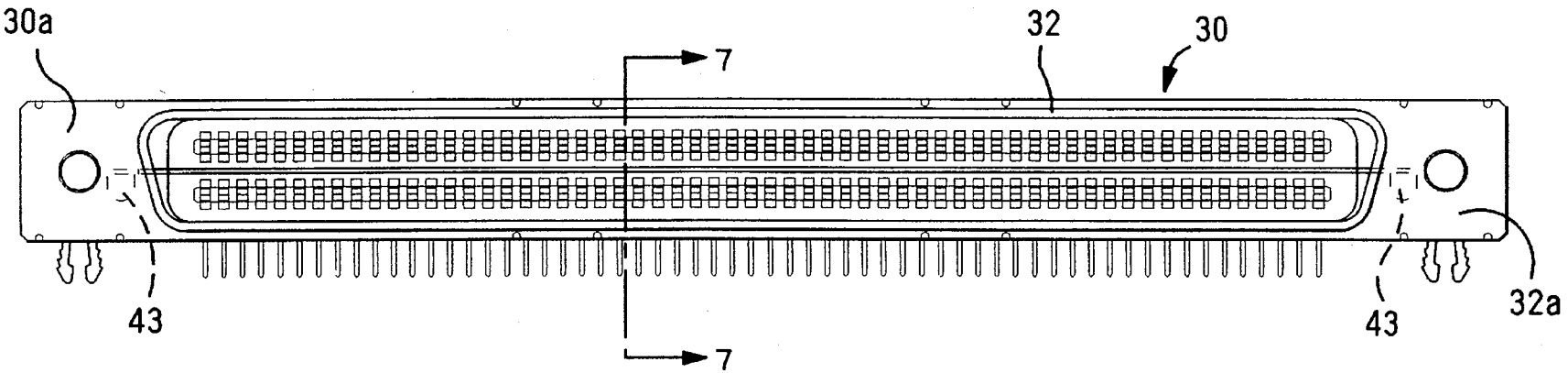
FIG. 6 is a front view of the mating connector which mates with the connector of FIG. 1 according to the instant invention.
Figure 7:
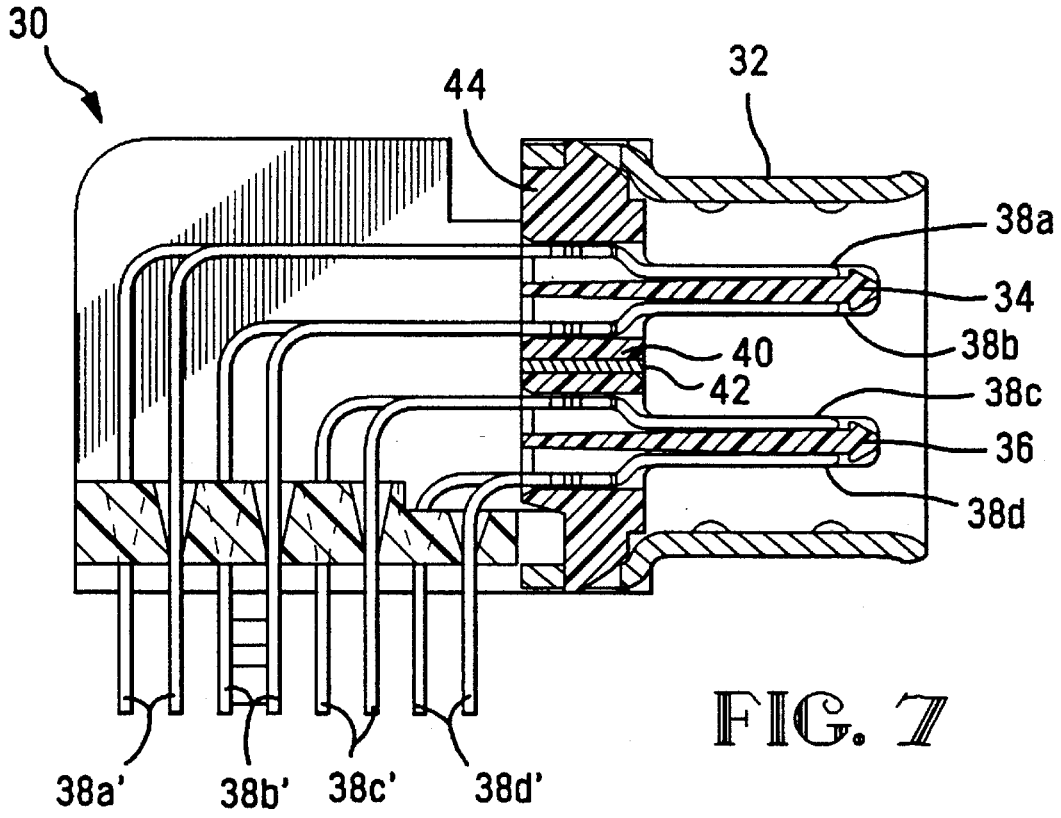
FIG. 7 is a cross-sectional view along line 7—7 shown in FIG. 6.
Figure 8:
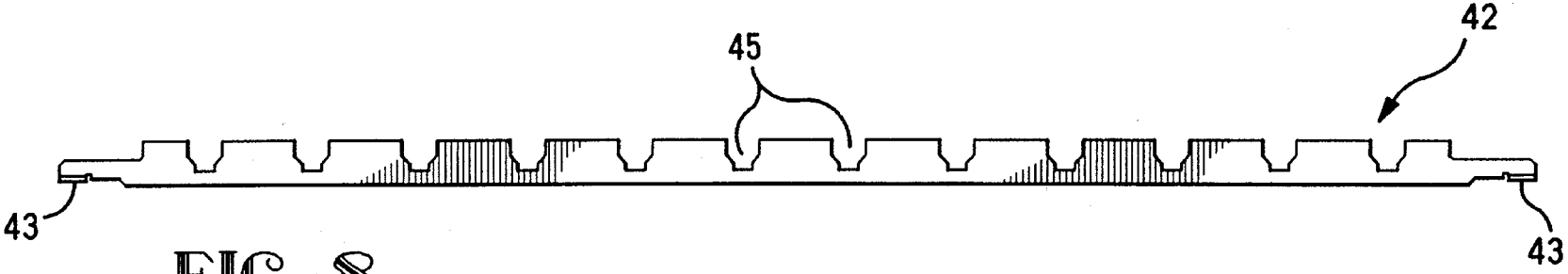
FIG. 8 is a plan view of the metal sheet inserted in the shielded electrical connector of FIG. 6.
Figure 9:
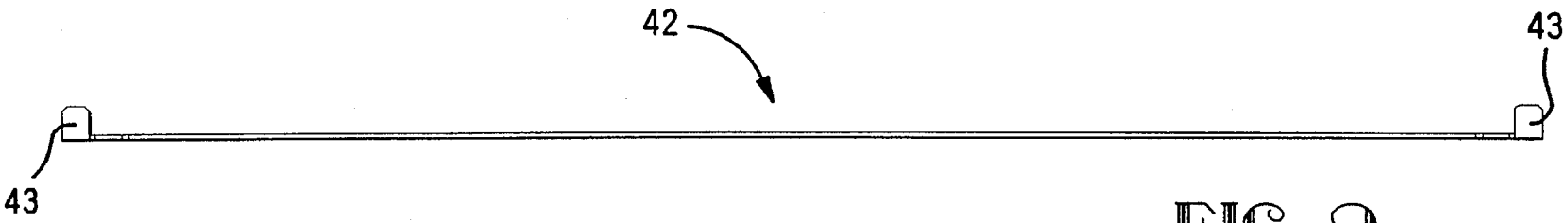
FIG. 9 is a side view of the metal sheet inserted in the shielded electrical connector of FIG. 6.
Figure 10:
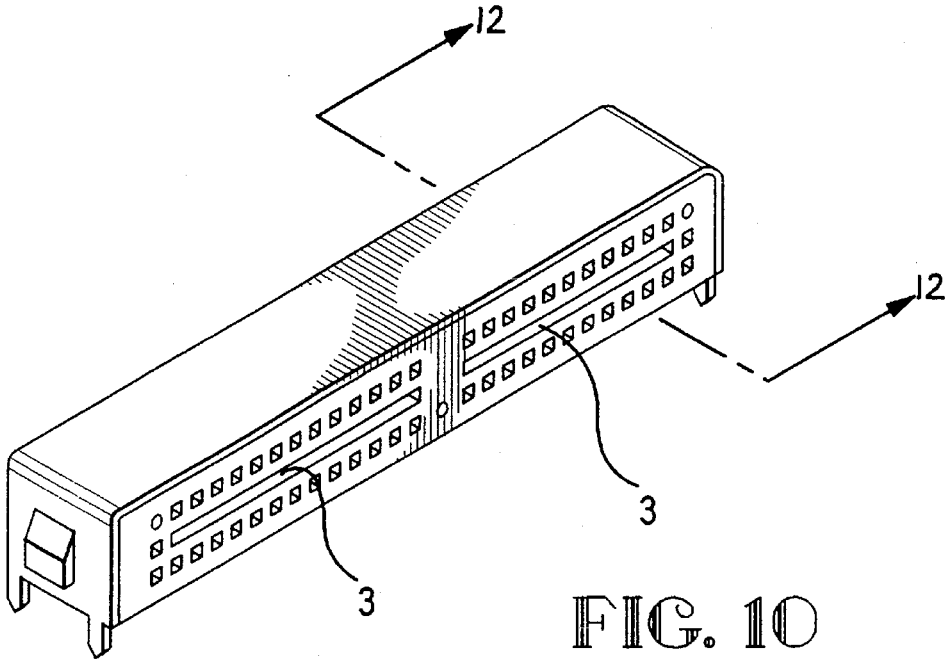
FIG. 10 ( PRIOR ART )
FIG. 10 is an oblique view of an electrical connector according to a conventional utility model.
Figure 11:
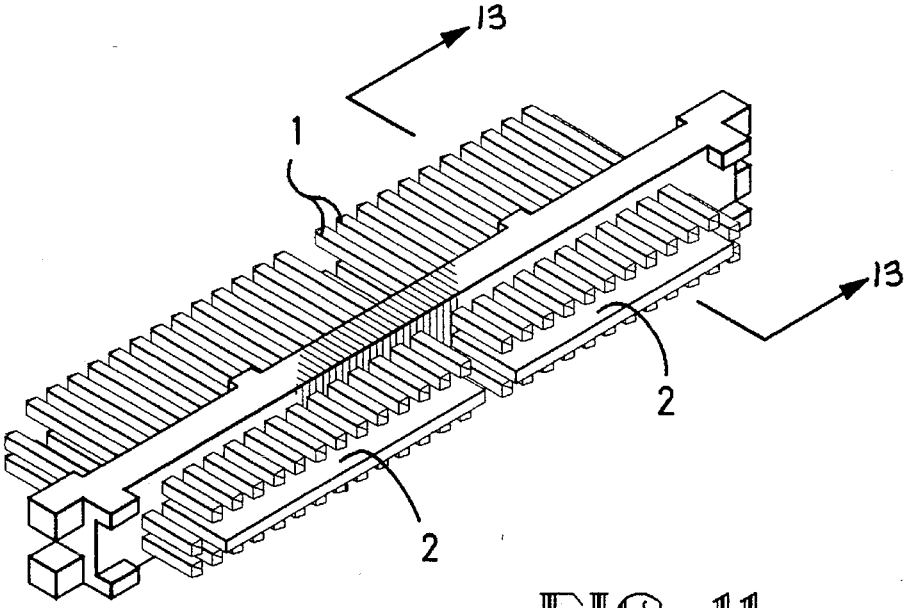
FIG. 11 ( PRIOR ART )
FIG. 11 is an oblique view of the sheet with contacts to be used with the the connector of FIG. 10.
Figure 12:
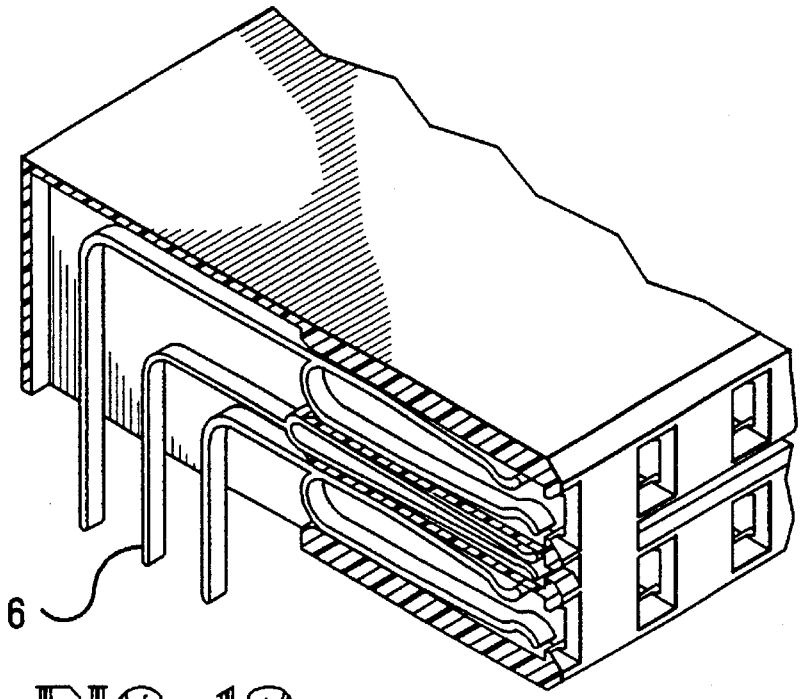
FIG. 12 ( Prior Art )
FIGS. 12–13 are oblique views of details shown in FIG. 10 with cross-sections made along lines 12—12 and 13—13.
Figure 13:
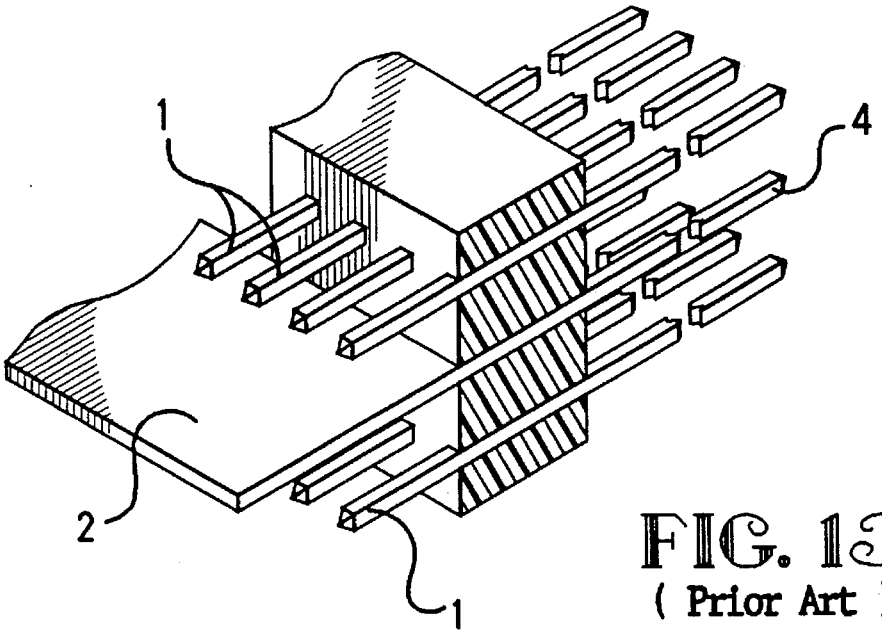
FIG. 13 ( Prior Art )
Figure 14:
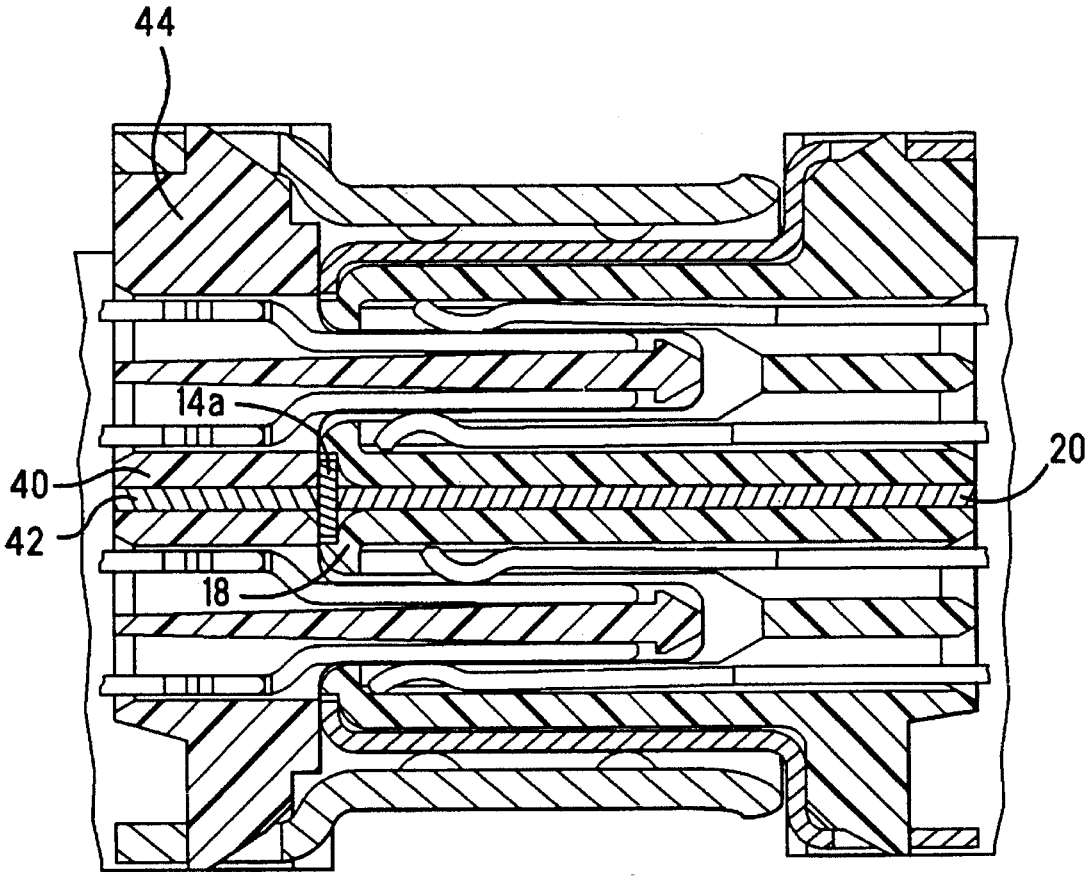
FIG. 14 is a partial cross-sectional view of the connectors of FIGS. 2 and 7 in a mated condition.

FIG. 6 is a front view of another embodiment of the shielded electrical connector according to this invention as seen from the side of a matching or mating connector; FIG. 7 is a cross-section of the connector shown in FIG. 6 along line 7—7; FIG. 8 is a top and FIG. 9 is a front view of the metal sheet incorporated in the shielded electrical connector according to the instant invention. The shielded electrical connector of FIG. 7 is a mating connector for the shielded electrical connector shown in FIGS. 1–5.

The shielded electrical connector 30 has a metal shell 32 shaped like a letter "D" inside of which the protruding portion 12 of the shielded electrical connector 10 shown in FIGS. 1–2 is inserted. Inside the metal shell 32, there is a housing 44 protrusion 34 on both sides of which there are contacts 38*a* and 38*b* arranged in rows, and a housing 44 protrusion 36 on both sides of which there are contacts 38*c* and 38*d* arranged in rows. The contacts 38*a*, 38*b*, 38*c*, and 38*d* form an electrical connection with the respective contacts 16*a*, 16*b*, 16*c* and 16*d* shown in FIG. 2 when the connectors are joined together Tie-ins 38*a'*, 38*b'*, 38*c'* and 38*d'* of the contacts 38*a*, 38*b*, 38*c* and 38*d* extend downward from the housing 44 as shown in FIGS. 6 and 7, and are soldered to terminals made on the printed circuit board (not shown in the Figure). Contacts 38*b* of the second row are separated from contacts 38*c* by the internal partition 40 of the housing 44 into which a metal sheet 42 of the shape shown in FIGS. 8–9 is embedded. At both ends of the metal sheet 42, bends 43 are formed which come in contact with the back side of the flange portion of the metal shell 32, thus producing an electrical connection between the metal sheet 42 and the metal shell 32.

When the connector 10, shown in FIGS. 1–5, and the connector 30, shown in FIGS. 6–9, are mated together the metal sheet 20 of the connector 10 and the metal sheet 42 of the connector 30 form an electrical connection through metal shells 14 and 32, thus preventing cross-talk between contacts 16*a*, 16*b*; 38*a*, 38*b* of the upper two rows and contacts 16*c*, 16*d*; 38*c*, 38*d* of the lower two rows. It is also possible to make the electrical connection by sandwiching a tip 14*a* (see FIG. 2) of the metal sheet 20 between metal sheet 20 and metal sheet 42.

In the two embodiments described above, metal sheets 20 and 42 are embedded in internal partitions 18 and 40 separating two upper rows and two lower rows of contacts, thus eliminating the possibility of cross-talk between these two rows. It is also possible to make several internal partitions with embedded metal sheets for further elimination of cross-talk between the contacts. In the embodiments described above, the metal sheet is inserted after the housing 24 or 44 was made, however, the housing can be made by an insert-molding method in which the metal sheet is embedded in the process of manufacture.

As has been explained above, the shielded electrical connector according to the instant invention has metal sheet, which is in contact with the metal shell, embedded by pressing or by insert molding into the internal partition thus eliminating cross-talk between the rows of contacts and preventing the internal partition from damage, resulting in implementation of a small sized, but effective electrical connector.

We claim:

1. An electrical connector assembly comprising:

a first electrical connector having a first dielectric housing disposed within a metallic shell, the housing including at least two rows of electrical contacts;

a second electrical connector having a second dielectric housing disposed within a metallic shell, the housing including at least two rows of electrical contacts, the first and second electrical connectors being matable to each other;

wherein at least one of the first and second housings of the electrical connectors includes a metal sheet disposed between the rows of contacts, and having longitudinal ends with tip surfaces thereof which are in electrical engagement with a surface of at least one metallic shell; and wherein said longitudinal ends of the metal sheet are bent to conform to the shape of the metallic shell.

2. The electrical connector assembly of claim 1, wherein the sheet is formed with a plurality of grooves which engage partitions formed in the housing of the electrical connector and are thereby maintained in position.

3. The electrical connector assembly of claim 1, wherein the bends engage a rear flange of the metallic shell.

4. The electrical connector assembly of claim 1, wherein each of the first and second housings includes a metal sheet in electrical contact with their respective metallic shells, wherein electrical continuity exists between the metallic shell of the first housing and the metal sheet of the second housing.

5. The electrical connector assembly of claim 4, wherein at least one of the metal sheets includes a metallic tip member which engages the other respective one of the sheets when the first and second electrical connectors are mated together.

6. The electrical connector assembly of claim 4, wherein the depth dimension of the first electrical connector's metal sheet is larger than the depth dimension of the second electrical connector housing.

7. An electrical connector comprising:

a dielectric housing disposed within a metallic shell, the housing including at least two rows of electrical contacts;

wherein the housing of the electrical connector includes a metal sheet disposed between the rows of electrical contacts, and the metal sheet having longitudinal ends thereof which are in electrical engagement with a surface of the metallic shell, said sheet has a sheet section disposed between said longitudinal ends, wherein said sheet section is a planar section; and wherein the sheet is formed with a plurality of grooves which engage partitions formed in the housing of the electrical connector and the sheet is thereby maintained in position.

8. The electrical connector assembly of claim 7, wherein said longitudinal ends of the metal sheet are bent to conform to the shape of the metallic shell.

9. An electrical connector assembly comprising:

a first electrical connector having a first dielectric housing disposed within a metallic shell, the housing including at least two rows of electrical contacts;

a second electrical connector having a second dielectric housing disposed within a metallic shell, the housing including at least two rows of electrical contacts, the first and second electrical connectors being matable to each other;

each of the first and second housings includes a metal sheet in electrical contact with their respective metallic shells, wherein electrical continuity exists between the metallic shell of the first housing and the metal sheet of the second housing when the connectors are mated;

wherein at least one of the metal sheets includes a metallic tip member which engages the other respective one of the sheets when the first and second electrical connectors are mated together; and wherein a tip surface of at least one metal sheet is bent to conform to the shape of the metallic shell and are in electrical engagement therewith.

10. The electrical connector assembly of claim 9, wherein at least one sheet is formed with a plurality of grooves which engage partitions formed in the housing of the electrical connector and are thereby maintained in position.

11. The electrical connector assembly of claim 9, wherein the at least one bend engages a rear flange of the metallic shell.

* * * * *